362-110
5/8/79 XR 4,153,927

United States Patent [19]

Owens

[11] 4,153,927

[45] May 8, 1979

[54] MULTI-FUNCTION CLIPBOARD APPARATUS

[76] Inventor: Ossie E. Owens, 2515 S. Mountain Ave., Phoenix, Ariz. 85040

[21] Appl. No.: 825,406

[22] Filed: Aug. 17, 1977

[51] Int. Cl.[2] ..... F21V 33/00; F41G 1/34

[52] U.S. Cl. ..... 362/99; 362/110; 362/253; 362/457

[58] Field of Search ..... 240/2 D, 2 PA, 6.4 B, 240/6.4 R; 362/98, 99, 109, 110, 111, 112, 113, 114, 154, 253, 457

[56] References Cited

U.S. PATENT DOCUMENTS 1,320,537 11/1919 Dimond ..... 240/6.4 B
1,889,373 11/1932 Pereira ..... 362/99
1,985,335 12/1934 Bloss ..... 240/6.4 B
2,955,194 10/1960 Clyne ..... 240/6.4 B

*Primary Examiner*—William M. Shoop
*Assistant Examiner*—Peter S. Wong
*Attorney, Agent, or Firm*—H. Gordon Shields

[57] ABSTRACT

A multi-function clipboard and report apparatus is disclosed which includes a receptacle for the storage of various items and provisions for two types of lights, one for illuminating the top surface of the clipboard and a second for providing a spotlight or a flashlight, and the apparatus also includes a gun capable of firing either a tear gas cartridge or a bullet and which contains a camera, a tape recorder, and which may act as a shield against projectiles.

14 Claims, 14 Drawing Figures

FIG. 4
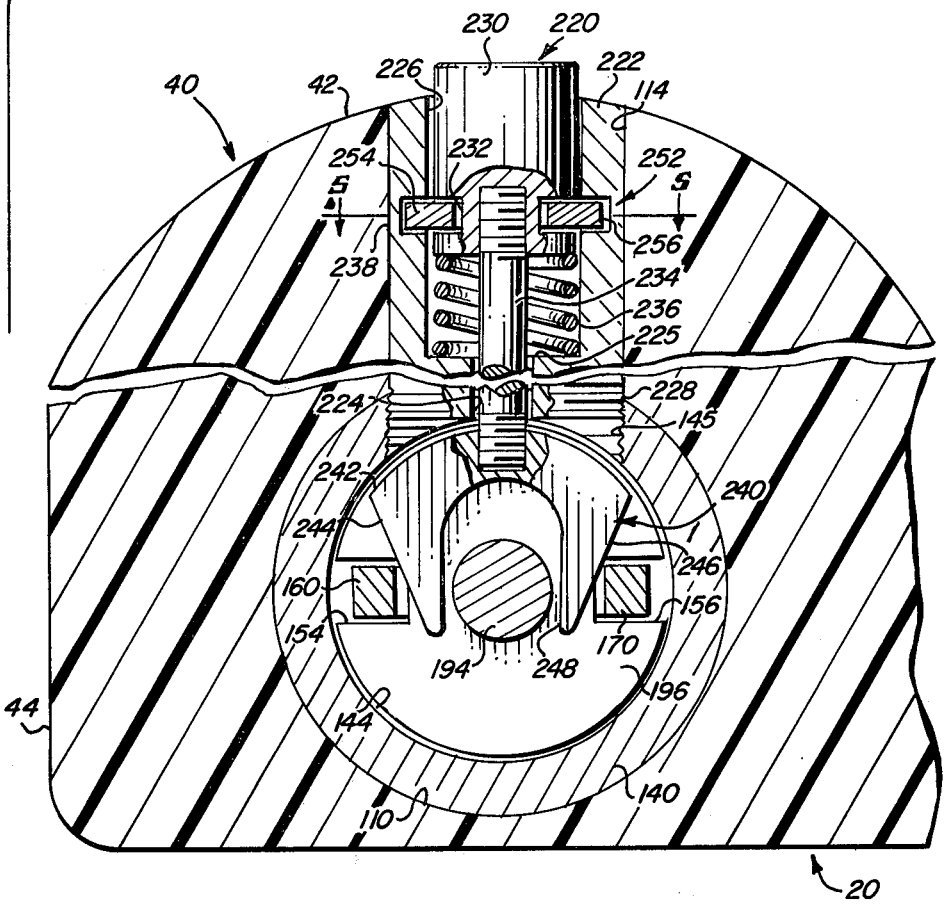
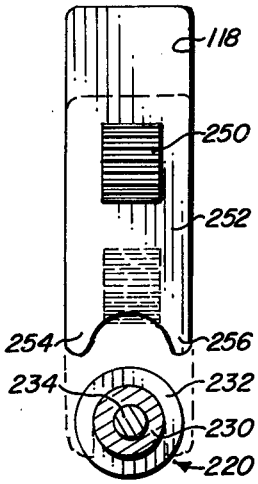
FIG. 5
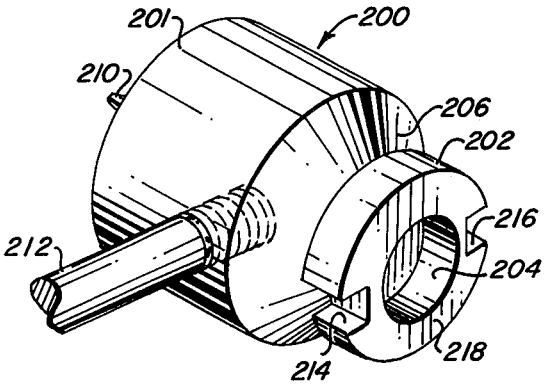
FIG. 6

MULTI-FUNCTION CLIPBOARD APPARATUS

BACKGROUND OF THE INVENTION

1. Field of the Invention

This invention relates to clipboards, and more particularly, to a multi-function clipboard and report apparatus for law enforcement officers, including the provisions for report forms, lights, a gun, and other related apparatus.

2. Description of the Prior Art

For convenience in taking notes, filling out forms, and the like, in either the standing position or sitting position, the ordinary, simple clipboard is extremely useful. A simple clipboard comprises a relatively firm, flat or planar surface on which paper is disposed and a spring clip of some type to hold or secure the paper to the surface of the board and to maintain the paper in a desired orientation on the board. Such relatively simple clipboards have been in use for many years.

Law enforcement officers perform several different functions during their normal course of activity. Filling out accident investigation forms, filling out traffic or warning tickets, interviewing witnesses, and interviewing suspects are but a few of the functions performed by law enforcement officers and for which they are required to write either on a form or from a pad of forms. Typically, many different forms are carried in each law enforcement patrol car and the officer simply selects the appropriate form which he anticipates using as he leaves his patrol vehicle to either approach another vehicle or to approach individuals or groups of individuals. The officer must return to his vehicle each time a different form is required.

Night patrols bring new problems. In addition to the usual various forms which they use, they must also provide some type of light to illuminate their forms and also to view individuals, vehicles, or the ground, a roadway, or the like. In other words, in addition to accomplishing the normal duties that are accomplished during the day, light must additionally be supplied at night. Typically, an officer tries to hold a flashlight in one hand while he writes with the other hand, or he tries to hold a flashlight under his arm while using one hand to steady or hold a clipboard or form pad while he writes with the other hand.

One obvious solution to help alleviate some of the problems of the law enforcement officer is to provide a light source to illuminate the clipboard while he writes. Clipboards with lights have been used for many years by aircraft crews. The particular type clipboard used by pilots comprises the so-called knee clipboard which comprises a small clipboard secured to the thigh of the user by a strap. The light source in the clipboard is typically a small bulb powered by C or D size flashlight batteries. This type of light source may also be provided for a hand-held clipboard used by a law enforcement officer, but it does not answer the need for a flashlight or spotlight type of light source.

One of the perils or hazards that each law enforcement officer faces, particularly at night, is the problem of being attacked by one or more assailants while he has both hands busy holding a clipboard and a flashlight under his arm, and writing at the same time. With both hands occupied, it is difficult to use a service revolver or the like in a sudden emergency. In addition to a service revolver, law enforcement officers generally carry some type of chemical weapon, such as chemical mace, which, while non-lethal, is generally effective in controlling belligerent assailants or suspects. However, with his hands occupied, it is again difficult for an officer to use such non-lethal weapons in an emergency.

In a recent year, about eleven percent of the fatalities involving law enforcement officers occurred during traffic pursuits and stops. It is obviously not possible to determine whether any of the fatalities could have been prevented had the officers been equipped with the apparatus of the present invention. However, it is obvious that apparatus of the present invention would have given the officers an extra edge which may have made substantial difference. Such apparatus may have been useful in several different areas, such as the discharge of tear gas at a potential assailant, using the light to illuminate the interior of a vehicle and/or to partially blind any occupant/potential assailant in the car. Law enforcement officers are also periodically in need of a safety shield to ward off blows or to protect themselves from projectiles such as bullets, rocks, and the like. Such shields are in use currently in the form of bulletproof vests and riot shields, but shields are not immediately available to the officers.

In addition to the various problems noted above which confront an officer, there are other situations in which an officer finds himself where additional apparatus in a convenient package may be of great value, such as a tape recorder to record comments, testimony, and the like, of various individuals and other various circumstances. Obviously, tape recorders are well known in the art and may range in size from very small ind inexpensive to rather large, cumbersome, and expensive units. The cost and complexity of such tape recorders may vary substantially. However, for law enforcement work, primarily concerned with on-the-spot comments or testimony, a relatively small tape recorder is sufficient, if such tape recorder is handy.

The comments made above with respect to a tape recorder also apply to a camera. The taking of a photograph may be very important to an officer under a variety of possible circumstances. Future identification of an individual, or an immediate view of the occupants of an automotile, and other circumstances may arise in which an officer has a need for the ability to take a picture virtually immediately and "on the spot."

With respect to the above-noted situations or problems that confront law enforcement personnel, there has not been heretofore a single apparatus which cooperatively provides all or even some of the solutions to the various problems as discussed. The apparatus of the present invention may combine all or some of the apparatus, depending on the particular needs or emphasis desired by individual law enforcement officers or agencies. The apparatus disclosed and claimed herein provides an "extra edge" for efficient, safe law enforcement.

SUMMARY OF THE INVENTION

The apparatus disclosed and claimed herein comprises a multi-purpose or multi-function clipboard unit having a plurality of compartments for holding various papers or documents needed in law enforcement work, and the apparatus includes provisions for two separate light sources, one for illuminating the surface of the board on which an officer may write and a second light source for providing a spotlight type light source, and the apparatus further provides a gun for firing a tear gas cartridge or a bullet (projectile) cartridge, or a canister for spraying a chemical. A tape recorder and a camera may also be included in the apparatus, and all of the separate elements may be actuated virtually instantaneously by an officer holding the clipboard.

Among the objects of the present invention are the following:

to provide new and useful clipboard apparatus;

to provide new and useful clipboard apparatus including a plurality of storage compartments;

to provide new and useful apparatus having two separate light sources;

to provide new and useful cartridge firing apparatus;

to provide new and useful apparatus comrising the functions of storing paper and forms with the utilization of the forms;

to provide new and useful apparatus for illuminating a writing surface and for illuminating the area adjacent to the writing surface;

to provide new and useful apparatus for firing different types of cartridge;

to provide new and useful clipboard apparatus including a tape recorder and a camera; and to provide new and useful clipboard apparatus for shielding the user of the apparatus from thrown or fired objects and missiles.

BRIEF DESCRIPTION OF THE DRAWING

FIG. 4 is an enlarged view in partial section of a portion of the apparatus of FIG. 3 taken generally along line 4—4 of FIG. 3.

FIG. 5 is an enlarged view of a portion of the apparatus of FIG. 4 taken generally along line 5—5 of FIG. 4.

FIG. 6 is an enlarged perspective view of a portion of the apparatus of FIGS. 2 and 3.

DESCRIPTION OF THE PREFERRED EMBODIMENT

Figure 1:
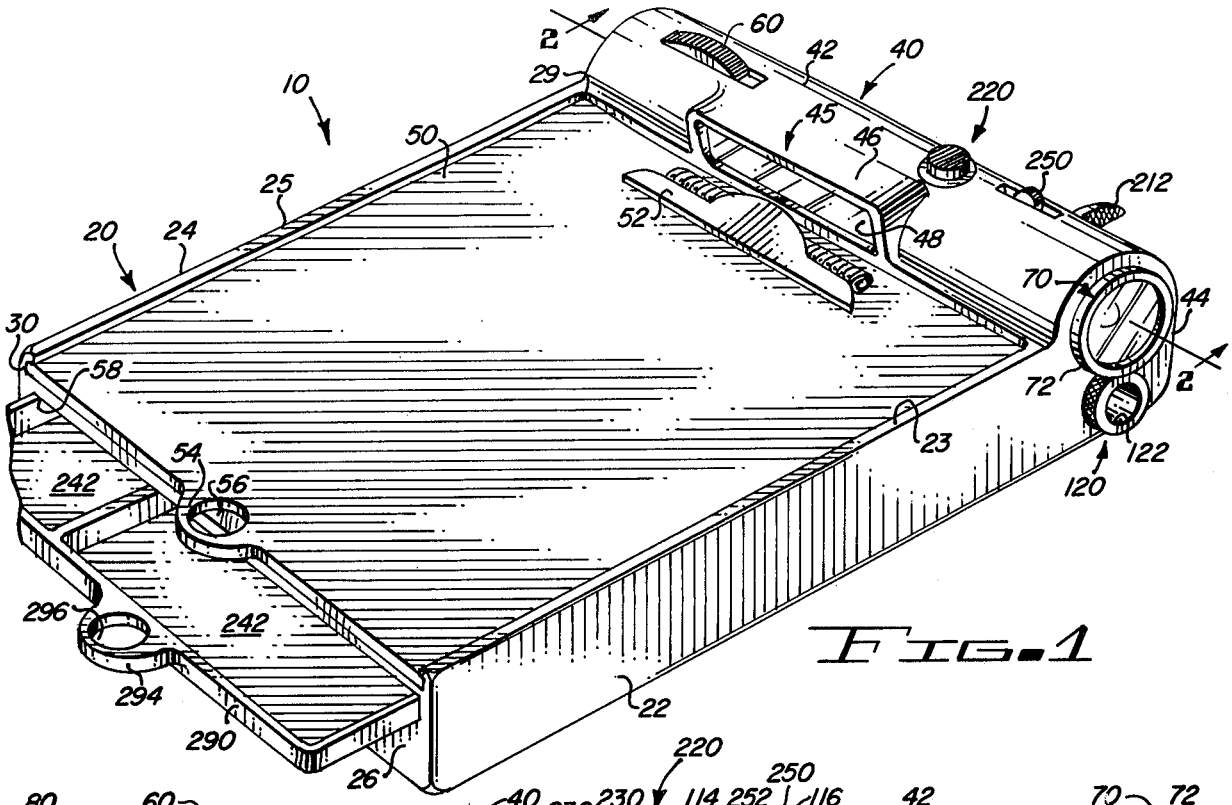
FIG. 1 is a perspective view of clipboard apparatus of the present invention.

FIG. 1 is a perspective view of clipboard apparatus 10 of the present invention. The apparatus includes a generally rectangular base 20 which is compartmentalized, as illustrated below in conjunction with FIG. 8. The rectangular base 20 is closed by a sliding top 50. The sliding top 50 comprises the clipboard surface on which the user writes. Appropriate papers or documents, or the like, are secured to the top 50 by a spring-loaded clip 52. The clip 52 is of a well-known design which is secured to the top and a portion of which pivots away from the top under the finger or hand pressure of the user to allow paper, forms, or the like to be placed beneath the pivoting portion of the clip 52. When the clip is released, a spring force biases the clip downwardly to securely hold the paper onto the top 50.

The base 20, with the top 50, may be of any appropriate dimensions with respect to its length, width, and height. The height or thickness of the base will vary according to the equipment or accessories contained therein. The length and width may also vary according to the accessories included in the apparatus, and may typically be of either of the popular sizes, letter size or legal size. Obviously, any dimensions as desired may be used.

The base 20 includes a right wide wall 22, a left side wall 24, a back or lower end wall 26, and a forward end or portion 40. The right and left side walls 22 and 24 each include a top rim or edge 23 and 25, respectively. The slide or top 50 is disposed in a groove 30 which extends inwardly into the sides 22 and 24 to receive the slide 50. The top rims or edges 23 and 25 accordingly extend above the top surface of the slide 50. At the forward or front end of the base 20, at the juncture of the base and the forward end 40 is a top rim or edge 29 which extends between the top rims 23 and 25. The top rims 23, 29, and 25 are continuous. The back end wall 26 is lower than the sides 22 and 24 to accommodate the top or slide 50, and also to accommodate a subtray 290.

For convenience in moving the slide 50, an extension 54 extends rearwardly of the slide and an aperture 56 extends through the extension 54. The aperture provides a convenient finger or thumb hold which a user may use in moving the slide 50 in the groove 30 of the base 20.

The tray 290 is disposed beneath the top 50 in a groove 58 which is substantially identical to the groove 30. The groove 58 is disposed below, and spaced apart from, the groove 30. The subtray 290 is an auxiliary tray which may be used to supplement the compartments described in FIGS. 8 and 16 and discussed in detail in conjunction therewith. The tray 290 includes a plurality of relatively shallow depressions 292 in which may be disposed papers, forms, and the like. The subtray 290 may be pulled out of the base 20 independently of the slide 50 to provide quick and easy access to forms. In the alternative, slide 50 may be pulled out to provide access to the forms in the tray 290.

The tray 290 includes an extension 294 with an aperture 296 extending through the extension. The extension and aperture are for moving the tray relative to the base. They perform the same functions as the extension 54 and aperture 56 of tray 50. The extensions 54 and 294 are offset vertically and horizontally from each other, but are relatively close so they may be moved together by a user to provide access for the compartments in the base.

The forward end 40 of the clipboard apparatus 10 extends upwardly vertically to a height greater than that of the base 20. The reason for the vertical height is to accommodate the light and gun portions of the apparatus. The forward end includes a generally curved top portion 42 which extends upwardly from the front edge 29. The curved portion 42 extends to, and terminates at, a forward or front wall 44 which is substantially parallel to the lower or back end wall 26. The generally smoothly extending curvature of the top portion 42 is broken by a rearwardly extending hood 46 which extends rearwardly. The hood 46 includes a glass plate 48 which is disposed toward the top or slide 50. A lamp is disposed within the hood 46 and, when an appropriate electrical circuitry, controlled by switch 60 is closed, the lamp illuminates and shines through the lens 48 onto the top surface of the slide 50 to thus illuminate any forms, paper, or the like secured to the top by the clip 52.

The lamp within the hood 46, with its reflector, is designed to be of the floodlight type, rather than a spotlight type, to illuminate as wide an area of the top 50 as is practical.

The switch 60 controls also a second light, which is a spotlight 70. The spotlight 70 is located within the forward end 40 of the clipboard apparatus, and is directed substantially parallel with the longitudinal axis of the forward end 40, which is laterally with respect to the sides 22 and 24 of the clipboard apparatus. Included with the spotlight 70 is a ring or bezel 72, a portion of which extends outwardly from the side 22, and a portion of the bezel 72 is externally threaded to mate with an internally threaded portion of the forward end 40, as may be seen in FIG. 2. The spotlight shines away from the apparatus.

Beneath the spotlight 70 is a gun 120. The action for the gun 120 is disposed within the forward end 40 of the clipboard apparatus 10. A knurled portion 124 of a barrel 122 extends slightly outwardly from the side 22 of the clipboard apparatus 10.

Extending upwardly from the top portion 42 of the forward end 40 of the clipboard apparatus 10 is trigger mechanism 220 for firing the gun 120. Also on the top 42 of the forward end 40 is a safety 250 for the gun 180. A cocking lever or pin 212 extends outwardly from the front end wall 44 of the forward end 40. The details of the gun 120 will be discussed in detail below in conjunction with FIGS. 2, 3, 4, 5, and 6.

Figure 2:
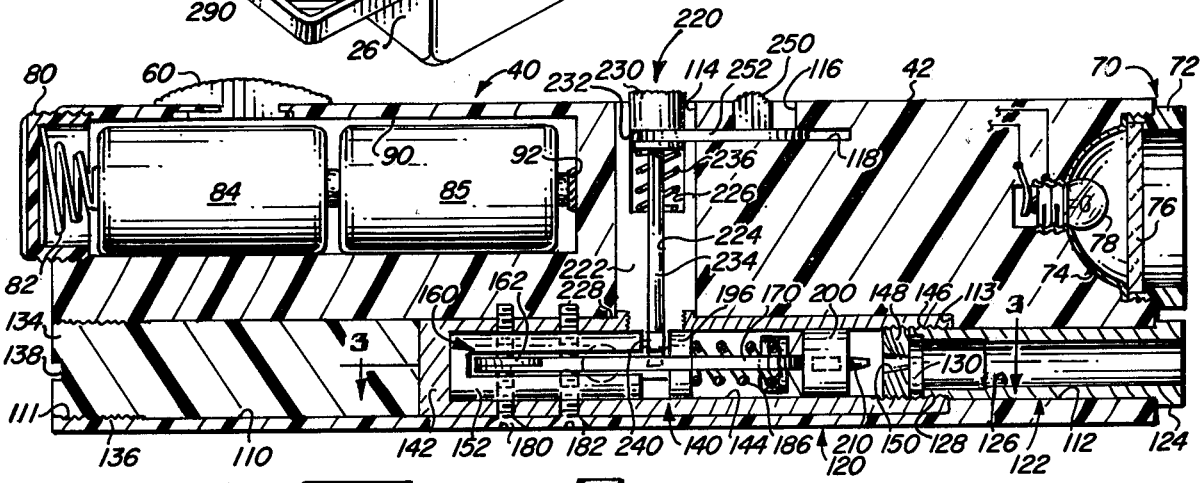
FIG. 2 is a view in partial section of the apparatus of FIG. 1 taken generally along line 2—2 of FIG. 1.

FIG. 2 is a view in partial section of a portion of the apparatus of FIG. 1 taken generally along line 2—2 of FIG. 1. It comprises a view in partial section through the forward portion 40 of the clipboard apparatus 10.

The forward portion 40 of the clipboard apparatus 10 is preferably of generally solid construction, and preferably made, with the rest of the base, of a relatively strong material, such as a polycarbonate marketed under the trademark "Lexan." The entire base 20, including the forward portion 42, may be molded out of such material in a single operation. Appropriate bores are disposed within the forward portion 40, as shown in FIG. 2.

At the upper left hand portion of the forward end 40, as viewed in FIG. 1 and in FIG. 2, is a bore 90. The bore 90 extends transversely of the clipboard apparatus, or longitudinally with respect to the forward portion 40. The bore 90 receives a pair of batteries 84 and 85 which comprise a power source, or a part of a power source, for the floodlight 48 and the spotlight 70. Within the base 90 is appropriate circuitry required for both of the lights, such as an electrical contact 92 which makes electrical contact with the positive terminal or battery 85. The batteries 84 and 85 are held within the bore 90, and against the electrical contact 92, by a battery end cap 80, which includes external threads to engage in internally threaded portions of the bore 90. An electrically conductive spring 82 extends between the end of battery 84 and the end cap 80 to provide the appropriate and necessary spring bias to maintain electrical contact between the batteries 84 and 85 and the spring also provides or comprises a negative terminal or electrical contact for the electrical circuitry within the apparatus. Additional batteries may be connected in series with batteries 84 and 85 by appropriate electrical conductors to provide additional voltage for the lights and other accessories in the clipboard apparatus.

Disposed above the batteries 84 and 85 in switch 60, which comprises a slide switch making appropriate mechanical contact with electrical conductors to make and break (open and close) electrical circuitry for the lamps. The electrical circuitry involved will be discussed in detail below in conjunction with FIG. 10.

At the right hand end of the forward portion 40 of the clipboard apparatus 10 is the spotlight 70. The spotlight 70 includes the bezel 72, a portion of which extends outwardly from the side 22 of the base 20 (see FIG. 1) and which includes an externally threaded portion which matingly engages in an internally threaded portion of the forward end 40 of the clipboard apparatus. The bezel 72 holds in place within the forward end 40 a reflector 74 which in turn is connected to a lamp 78. A lens 76 is held in place against the reflector 74 by the bezel 72. Appropriate electrical circuitry connects the lamp 78 with the batteries 84 and 85 through the switch 60, as explained below in conjunction with FIG. 10.

Beneath the batteries 84 and 85 and the lamp 70 is a transversely extending groove 110. The groove 110 is transversely extending with respect to the clipboard apparatus 10, but longitudinally extending with respect to the forward end 40 of the clipboard apparatus. The bore 110 includes internal threads at one end, the left end as shown in FIG. 2. The bore 110 communicates with, and is axially aligned with, a second bore 112 which extends from the right-hand portion of the front end 40, as shown in FIG. 2. The bore 112 is actually a continuation of the bore 110 but may be of a reduced diameter, as shown in FIG. 2.

Within the bore 112 is the barrel 122 of the gun 120. Within the communicating bore 110 are other components or elements of the gun 120, as discussed below. The bore 110 may include an appropriate slot or keyway for aligning a cylinder received in the bore.

The barrel 122 includes a knurled portion 124 which extends outwardly from the side 22 of the base 20, as viewed in FIG. 1 and as also shown in FIG. 2. The knurled portion 22 is of a greater diameter than the bore 112 in which the barrel 122 is disposed. The knurled portion accordingly comprises an external portion of the barrel and its purpose is to allow the barrel 122 to be removed from the clipboard apparatus for loading and unloading the cartridge, as explained in detail below. When inserted into the bore 112, the knurled portion 124 preferably seats against the side 22 of the base 20.

The barrel 122 includes a bore 126 which may include appropriate lands and grooves (rifling), such as is well-known in the art. The barrel 122 also includes external threads 128 at one end of the barrel remote from the knurled portion 124. The external threads matingly engage internal threads 146 of a cylinder 140 to secure the barrel 122 to the clipboard apparatus 10. A counterbore 130 is disposed on the end of the barrel adjacent the threads 128. The counterbore 130 is coaxial with the bore 126 and it receives a cartridge. The longitudinal axis of the barrel 122 is generally parallel to the light beam from the spotlight 70. The spotlight thus illuminates the potential general target area for the gun.

The cylinder 140 is disposed within the bore 110. One end of the cylinder 140 is disposed against shoulder 113 defined at the juncture of the bores 110 and 112. The shoulder 113 extends radially inwardly from the bore 110 to the bore 112.

The cylinder 140 is held against the shoulder 113 by a plug 134 which is disposed against a closed end 142 of the cylinder 140. The plug 134 is preferably a solid plug which includes an externally threaded portion 136 which matingly engages an internally threaded portion 111 of the bore 110. The plug 134 also includes a transversely or diametrically extending slot 138 which may receive the blade of a screwdriver, or the like, in order to remove and insert the plug 134, as desired. The cylinder 140 may also include an appropriate key which may matingly engage a keyway or slot in the bore 110 for proper alignment of the cylinder 140, as discussed above.

The cylinder 140 includes an internal bore 144 which extends from the closed end 142 and terminates at an open end at the shoulder 113. At the opened end of the bore 144 are the internal threads 146 which engage the external threads 128 of the barrel 122. An externally threaded block 148 is disposed in the threaded portion 146 of the bore 144 and the barrel 122 is disposed against a face of the block 148. An aperture 150 extends through the block 148. The aperture 150 extends axially through the block 148 concentrically with respect to the block. As shown, the aperture 150 may be a conical shaped bore. The base of a cartridge is held against the face of the block 148 within the counterbore 130 and the aperture 150 allows a firing pin to contact the primer in the base of the cartridge to fire the cartridge.

Within the bore 144 of the cylinder 140, and disposed against the end wall 142, is a holding block 152. The holding block 152 includes a longitudinally extending pair of grooves or recesses 154 and 156 (see FIG. 3) in which are disposed a pair of latching fingers 160 and 170, respectively. The latching fingers 160 and 170 are secured together by a screw 180 which extends through the cylinder 140, the holding block 150, and into the forward end 40. The screw 180 provides a dual function of first, providing a pivot point for the latching fingers, and second, providing an additional securement for holding the cylinder 140 in the bore 110 and to the base 20 of the clipboard apparatus. The screw 180 extends through enlarged, pivoted ends 162 and 172 of the fingers 160 and 170, respectively. Remote from the pivoted ends 162 and 172 are latches 164 and 174, respectively. The latches 164 and 174 are on the ends of the fingers, remote from the screw 180 and the pivoted ends, as discussed. Intermediate the ends of the fingers 160 and 170 are a pair of apertured tabs 166 and 176 which extend inwardly from the respective fingers 160 and 170 towards the opposite finger. A tension spring 184 extends between the two tabs to bias the latching fingers towards each other.

A second screw 182 also extends through the holding block 152 between the fingers and into the forward end 40 of the apparatus. Both screws 180 and 182 help to insure that the gun portion 120 of the clipboard apparatus is held securely within the forward end 40.

Remote from the ends 162 and 172 of the fingers on the holding block 152 is a spring base 196. The spring base 196 includes a spring seat 198 against which is disposed one end of a compression spring 186. The spring 186 is disposed intermediate the latching fingers and between the spring base 186 of the holding block 152 and an appropriate spring seat 204 on a bolt 200.

The bolt 200 is disposed in the bore 144 of the cylinder 140 intermediate the holding block 152 and the block 148. The latching fingers hold the bolt 200 against the bias of the spring 186 until the gun is fired. The bolt 200 includes a firing pin 210. When the latching fingers are released by trigger mechanism 220, the bolt is moved by the force of the spring 186 in the bore 144 against the threaded block 148 and the firing pin 210 moves through the aperture 150 to contact the primer of a cartridge within the bore 126 of the barrel 122.

The trigger apparatus 220 is used to release the latching fingers 160 and 170 to allow the bolt 200 to move in the bore 144 under the bias of the compression spring 186. The trigger mechanism 220 includes a cylindrical portion 222 disposed in a vertically extending bore 114 in the forward end 40 of the base 20 of the clipboard apparatus 10. The bore 114 intersects the bore 110 at substantially a right angle, as shown in FIG. 4. The cylinder 222 includes an externally threaded portion 228 which engages an internally threaded aperture 145 in the cylinder 140 (see FIG. 4). The cylinder 222 includes a longitudinally extending bore 224 in which is disposed a pin 234. A counterbore 226 is disposed coaxially with respect to the bore 224. The counterbore 226 is of a larger diameter than the bore 224 and a compression spring 236 is disposed in the counterbore 226 about the portion of the pin 234 which is located in and extends through the counterbore 226. A button or head 230 is secured to the pin 234. The diameter of the button or head 230 is slightly less than the diameter of the counterbore 226 and the button or head 230 accordingly moves axially in the counterbore 226. The compression spring 236 extends between the underneath portion of the button or head 230 and the lower end of the counterbore 226 to bias the button or head 230, and accordingly the pin 234 secured thereto, upwardly or out of the bore and counterbore.

The button or head 230 includes a circumferentially extending slot 232 in which may be disposed portions of a slide 252 of safety 250. The slide 252 is disposed within a groove 118 which communicates with a recess 116 in which is disposed the safety 250. With the slide engaging the button or head 230, the trigger 220 is unable to move. However, with the slide disengaged from the slot or groove 232, the button 230 may be moved downwardly or inwardly with respect to the forward end 40 and against the bias of the spring 236 to fire the gun.

The firing of the gun is accomplished by means of a cam portion 240 which is secured on one end of the pin 234 remote from the button or head 230. The cam 240 is disposed intermediate the fingers 160 and 170 and, as the button 230 is moved downwardly, the cam 240 biases the fingers 160 and 170 radially outwardly to unlatch the bolt 200. The bolt 200, when unlatched from the fingers 160 and 170, is moved by force of the compression spring 186, and the firing pin 210 moves through the aperture 150 to contact the primer at the base of the cartridge in the barrel 122.

Figure 3:
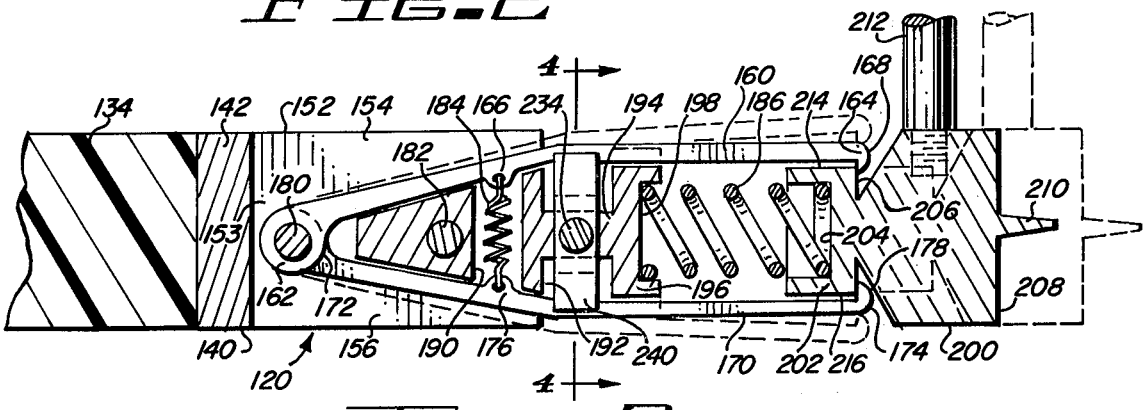
FIG. 3 is a view in partial section of a portion of the apparatus of FIG. 2 generally along line 3—3 of FIG. 2.

FIG. 3 is a view in partial section of a portion of the apparatus of FIG. 2 taken generally along line 3—3 of FIG. 2. It comprises an enlarged view of a portion of the gun apparatus 120.

The plug 134 is disposed against the closed end 142 of the cylinder 140. The holding block 152 is disposed within the bore 144 (see FIG. 2) of the cylinder 140, and is held in place by screws 180 and 182, as best shown in FIG. 2. The screw 180 extends through the ends 162 and 172 of the fingers 160 and 170, respectively. The screw 182 also extends through the holding block 152 to help secure the holding block and the cylinder 140 to the forward end 40 of the base 20.

The holding block 152 includes a laterally or transversely extending bore 190. The bore 190 communicates with a pair of recesses or grooves 154 and 156 in the holding block 152, which are a part of a larger recess 153. The recess 153 receives the ends 162 and 172 of the fingers 160 and 170, respectively. The fingers 160 and 170 include a pair of inwardly extending tabs 166 and 176 to which is secured a tension spring 184. The tension spring 184 biases the latching fingers 166 and 167 towards each other to maintain a latching hold on the bolt 200.

The holding block 152 includes a circumferentially extending groove 192 which receives te cam 240 of the trigger 220 (see FIG. 2). The spring base 196 is connected to the holding block 152 by connecting rod 194. The cam 240 is thus disposed in the groove 192 between the spring base 196 and the block 152. The spring base 196 includes a spring seat or recess 198 in which is disposed one end of the compression spring 186. The slots 154 and 156, in which the latching fingers 160 and 170, respectively, are disposed, also extends through the spring base 196.

The bolt 200 is of a circular cylindrical configuration, movable in the bore 144 of the cylinder 140. The bolt 200 includes a spring base 202 remotely from the firing pin 210: The spring base 202 includes a spring seat or recess 204 in which is disposed one end of the spring 186. The spring seats or recesses 198 and 204 are substantially identical, and face each other to receive opposite ends of the compression spring 186.

A circumferentially extending groove 206 extends about the spring base 202 to receive latches 164 and 174 of the latching fingers 160 and 170, respectively. The spring base 202 of the bolt 200 includes a pair of axially extending grooves 214 and 216 in which, or through which, are disposed the latching fingers 160 and 170, respectively.

The firing pin 210 extends longitudinally or axially outwardly from the bolt 200 from a forward face 208 of the bolt.

When the trigger 220 is actuated to fire the gun, the safety 250 is moved out of engagement with the head or button 230 (see FIG. 2) and the head or button is depressed to move the pin 234 downwardly or toward the latching fingers 160 and 170. The cam 240 secured to the pin 234 biases the latching fingers 160 and 170 radially outwardly against the bias of the tension spring 184 and the latches 164 and 174 are accordingly moved out of the groove 206. When the latches 164 and 174 move outwardly from the groove 206, the bolt 200 moves axially in the bore 144 (see FIG. 2) under the bias of the compression spring 186 to cause the firing pin 210 to contact the primer of a cartridge.

After the cartridge has been fired, the barrel 122 must be removed by disengaging the threaded connection with the cylinder 140 (see FIG. 2). This is accomplished, as stated above, by means of the knurled portion 124 of the barrel 122 which is disposed externally of the front end 40 and against the side 22 of the base 20 (see FIGS. 1 and 2). The fired cartridge is then removed from the counterbore 130 of the barrel 122 (see FIG. 2).

After the fired cartridge has been removed, a new cartridge may be inserted into the counterbore 130 of the barrel 122 and the barrel may then be inserted into its bore 112 in the forward end 40.

After firing the gun, the bolt 200 must be cocked or moved axially rearwardly to cause the latching fingers to engage the bolt. This is accomplished by means of a cocking lever or pin 212 which is secured to the bolt 200 and which moves longitudinally axially with respect to the bolt in a slot on the forward end 40 of the base 20 which communicates with the bore 110 through an appropriate or mating slot in the cylinder 140 from the front end wall 44 of the base 20. The cocking lever or pin 212 is secured to the bolt 200 preferably by a threaded engagement.

The forward or front portions 168 and 178 of the latching fingers 160 and 170 are curved or rounded. They comprise camming surfaces which cause the latching fingers 160 and 170 to move radially outwardly with respect to the spring base 202 of the bolt 200 as the bolt 200 is moved axially rearwardly against the bias of the spring 186 by the cocking lever or pin 212. The front portions or cam surfaces 168 and 178 accordingly are cammed against a rear face 218 of the spring base 202 as the bolt is moved by the cocking lever 212. The cam surfaces 168 and 178 engage the face 218 adjacent the grooves 214 and 216. As the latch portions 164 and 174 of the latching fingers move axially in the grooves 214 and 216, respectively, the tension spring 184 biases the latching fingers toward each other. Thus, when the latches 164 and 174 move into the circumferentially extending groove 206, and out of the axially extending slots 214 and 216, the fingers are biased together to securely retain or hold the bolt 200 against the bias of the compression spring 186.

After firing the gun, the user of the apparatus releases the firing button 230. With the button 230 released, the button and the pin 234 and cam 240 accordingly move upwardly under the urging or biasing force of the compression spring 236 (see FIG. 2). The cam 240 is accordingly moved out of engagement with the fingers 240 to allow the reloading and cocking of the apparatus to be accomplished.

As a safety feature, the length of the compression spring 186, which extends between the bolt 200 and the holding block 152, is predetermined so that after the gun has been fired, the spring 186 will not continuously bias the bolt 200 against the threaded block 148 (see FIG. 2). The firing pin is thus not biased through the aperture 150 of the threaded block 148 and against the primer of a cartridge freshly or newly inserted into the bore 126 of the barrel 122. This prevents the cartridge from being fired inadvertently as the barrel 122 is screwed into the cylinder 140 when the bolt 200 is not cocked. If desired, a relatively weak compression spring may be provided between the block 148 and the face 208 of the bolt 200 to bias the bolt away from the block 148 after firing. However, the depths of the spring seats 198 and 204 are preferably such that with the spring 186 in its fully extended, uncompressed state, it is still retained in the spring seats.

The movement of the latching fingers 160 and 170 and of the bolt 200 is shown in phantom in FIG. 3 in the firing position. When the pin 234 is moved downwardly to engage the cam 240 against the latching fingers, the latching fingers are moved outwardly to the position shown in phantom to thus release the bolt 200. The bolt 200 accordingly moves axially to the position shown in phantom under the force of the compression spring 186 to cause the firing pin to contact a primer in a cartridge, thus firing the gun. After firing, the bolt 200 is then moved axially rearwardly against the bias of the spring 186 by means of the cocking lever 212.

FIG. 4 is a view in partial section of the apparatus of FIG. 3 taken generally along line 4–4 of FIG. 3. It comprises an enlarged view in partial section illustrating the operation of the trigger 220.

FIG. 4 is a view of the gun apparatus 120 included in the front portion 40 of the clipboard apparatus 10 illustrated in FIG. 1. Within the bore 110 in the forward end 40 is a cylinder 140. Disposed within the bore 144 of the cylinder 110 is the spring base 196, which is part of the holding block 152 (see FIGS. 2 and 3). The latching fingers 160 and 170 extend through the pair of recesses 154 and 156, respectively, in the spring base 196.

Extending downwardly from the top 42 of the forward or front end 40 is the bore 114 which intersects the bore 110. Disposed within the bore 114 is a cylinder 222 which includes a lower threaded portion 228. The externally threaded portion 228 of the cylinder 222 matingly engages an internally threaded aperture 145 which extends radially through the wall of the cylinder 140. The cylinder 222 and the cylinder 140 are thus secured together at their respective threaded portions.

Within the cylinder 222 is a bore 224 which extends longitudinally through the cylinder 222. The bore 224 communicates directly with the elongated counterbore 226 which extends downwardly from the top of the cylinder 222 adjacent the top 42 of the front end 40. The bore 224 extends upwardly from the bottom portion of the cylinder 222 to intersect, axially, the bore 226. The bores 224 and 226 are thus coaxial with respect to the cylinder 222. The bore 224 communicates directly with the bore 144 of the cylinder 140.

Disposed within the counterbore 226 is the button or head 230 of the trigger mechanism 220. The button 230 is secured to a pin 234 which extends through the counterbore 226 and through the bore 224 and into the bore 144 of the cylinder 140. The pin 234 is secured at its upper end directly to the button 230, and is secured at its lower end to cam 240. A radially extending shoulder 255 is defined between the bore 224 and the counterbore 226. The shoulder 225 is the lower end wall for the counterbore. A compression spring 226 is disposed within the counterbore 226 and the spring extends between the shoulder 225 and the bottom of the button or head 230. The compression spring 236 accordingly biases the button 230, the pin 234, and the cam 240, vertically upwardly, as viewed in FIG. 4. The upward movement of the cam 240, and of the pin or connecting rod 234, and the button or head 230, connected thereto, is limited by the cylinder 140.

Disposed within the slots or recesses 154 and 156 of the spring base 196 are the latching fingers 160 and 170. A pair of cam surfaces 244 and 246 of the cam 240 are disposed adjacent the inner portions of the fingers 160 and 170. That is, the fingers 160 and 170 are disposed outwardly with respect to the cam 240, and adjacent the cam surfaces 244 and 246. The cam 240 includes a circular upper top surface 244 which has about the same radius of curvature as the bore 144. Accordingly, when the trigger 220 is disposed in its uppermost position, as shown in FIG. 4, the upper surface 242 of the cam 240 is substantially adjacent the upper portion of the bore 144 of the cylinder 140.

The cam surfaces 244 and 246 extend inwardly and downwardly from the outer ends of the curved upper surface 242 of the cam 240. The cam surfaces 244 and 246 are preferably relatively straight, but inclined inwardly and downwardly, as indicated. The cam 240 also includes a generally inverted U-shaped recess or slot 248 in which is disposed the connecting rod 194 of the holding block 152 (see FIG. 3).

As the trigger button 230 moves downwardly in the bore 226, the cam 240 moves downwardly, as viewed in FIG. 4, and the cam surfaces 244 and 246 bear against the latching fingers 160 and 170, respectively. Movement of the cam 240 downwardly causes the latching fingers to be moved radially outwardly to the position shown in phantom in FIG. 3. The outward movement of the latching fingers 160 and 170 releases the bolt 200 (see FIGS. 2 and 3) to cause the gun to fire.

The firing of the gun is prevented by the engagement of safety slide 252 with the button 230. The slide 252 is disposed within a pair of matching slots 232 and 238. The slot 232 is the circumferentially extending slot on the button 230, and the slot 238 is a mating slot extending through the cylinder 222. The slide 252 includes a bifurcated portion comprising a pair of arms 254 ad 256. The arms 254 and 256 are disposed in the mating grooves 232 and 238 of the button and the cylinder, respectively. With the slide 252 disposed in both the cylinder and the button, movement of the button, and of the trigger apparatus 220, is thus mechanically prevented. The slots 232 and 238 are horizontally aligned, as shown in FIG. 4, when the button 230 is in its uppermost position, under the bias of the spring 236. The curved upper surface 242 of the cam 240 is accordingly disposed against the bore 144 of the cylinder 140. In the upper position, as shown in FIG. 4, the cam surfaces 244 and 246 are not in engagement with the latching fingers 160 and 170. Rather, the latching fingers 160 and 170 are biased together by the spring 184 (see FIG. 3) to securely hold the bolt 200 in the cocked position, as also shown in FIG. 3.

When the gun apparatus is fired, by the inward or downward depression of the button 230 and the cam 240, the latching fingers release the bolt, thus allowing the firing pin on the bolt to strike the primer of a cartridge disposed in the gun. When the button 230 of the triggering mechanism is released, the button and cam are returned to the position shown in FIG. 4 under the bias or force of the spring 236. The latching fingers are then free to pivot inwardly (see FIGS. 2 and 3) under the bias of the tension spring 184 to the position shown in FIG. 4 (and also FIG. 3). However, the trigger 220 must be in the "up" position, as shown in FIG. 4, in order for the bolt 200 to be cocked for future fitting. This is due to the fact that the cam surfaces on the ends of the latching fingers (see FIG. 3) cause the latching fingers to be moved outwardly by the bolt as the bolt is cocked and prior to the engagement of the latching fingers with the groove 206 to lock the bolt in the cocked position. If the latching fingers are not able to move inwardly to engage or latch with the bolt, the bolt will not stay in the cocked position. If the cam 240 is in its downward or firing position, the latching fingers will be prevented from moving inwardly to engage or latch the bolt 200.

FIG. 5 is a view of a portion of the apparatus of FIG. 4 taken generally along line 5–5 of FIG. 4. It comprises a vertical view in partial section of the safety 250. The safety 250 moves longitudinally with respect to the end portion 40 (see FIGS. 1, 2, and 4) in the forward or front end 40. The plate 252 of the safety includes a bifurcated portion comprising a pair of fingers 254 and 256. The fingers 254 and 256 are spaced apart and engage the firing button or head 230 of the trigger mechanism 220, as shown in phantom in FIG. 5. The slide 252 extends into the slot 232 of the button 230 to lock the button 230 relative to the end portion 40 (see FIGS. 2 and 4).

FIG. 6 is an enlarged perspective view of a portion of the apparatus of FIGS. 2 and 3. It comprises an enlarged view of the bolt 200. The bolt 200 includes a generally cylindrical portion 201 movable in the bore 144 (see FIG. 2). The firing pin 210 extends axially forwardly from the front face 208 of the cylindrical portion 201 of the bolt 200 (see FIGS. 2 and 3). Extending radially outwardly from the cylindrical portion 201 is the cocking lever or pin 212. The cocking pin 212 includes an externally threaded portion which engages a mating, internally threaded bore of the cylindrical portion 201. For disassembly of the cam apparatus, the cocking pin or lever 212 must be removed from the bolt 200 in order to allow the bolt to be removed with the cylinder 140 in which it is disposed.

Rearwardly of the cylindrical portion of the bolt 200 is the spring base 202. The spring base 202 includes a cup or recess 204 which comprises a seat for the compression spring 186 (see FIGS. 2 and 3). The spring 186 in turn provides the force for moving the bolt axially or longitudinally within the bore 144 of the cylinder 140 when the trigger apparatus 220 is depressed to fire the gun. The firing pin 210 which extends from the front face 208 (see FIG. 3) of the bolt 200 contacts the primer of a cartridge and results in the firing of the gun. The cup or recess 204 comprises an axially extending bore which extends forwardly from the rear face 218 of the spring base 202.

The spring base 202 is separated from the cylindrical portion 201 by a circumferentially extending groove 206. The groove may best be seen and understood by referring also to FIG. 2 and to FIG. 3. The latching fingers 160 and 170, also shown in FIGS. 2 and 3, lock onto, or latch onto the bolt 200 at the groove 206, as shown in FIGS. 2 and 3.

A pair of longitudinally axially extending slots 214 and 216 are disposed diametrically opposite each other on the spring base 202 and they extend inwardly from the outer periphery of the spring base. The slots 214 and 216 receive the latching fingers 160 and 170, respectively, as shown in FIG. 3. Movement of the latching fingers out of the slots 214 and 216 releases the bolt 200 and the bolt is then propelled forwardly in the bore 144 by the compression spring 186 (see again FIGS. 2 and 3).

Figure 7:
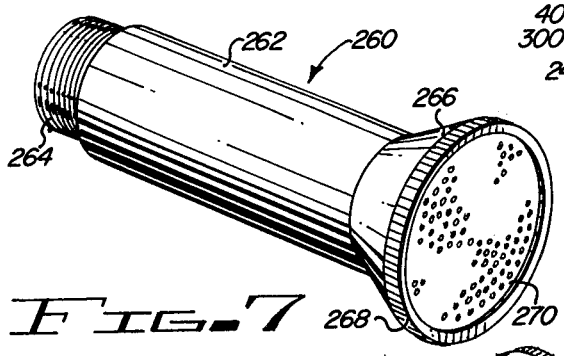
FIG. 7 is a perspective view of an alternate embodiment of a barrel usable with the apparatus of FIG. 2.

FIG. 7 is a perspective view of an alternate embodiment of a barrel 260 usable with the gun apparatus 120 of the clipboard apparatus 10 of the present invention. The barrel 260 comprises a tear gas barrel for shooting tear gas cartridges in the gun apparatus 120.

The tear gas barrel 260 includes an elongated cylindrical portion 262 which has a bore extending therethrough. The cylindrical portion 262 has an externally threaded portion 264 at one end which matingly engages the internally threaded portion 146 of the cylinder 140 (see FIG. 2). Remote from the external threads 264 is an outwardly flaring portion 266. The flared portion 266 of the barrel 260 is disposed outwardly of the side 22 of the clipboard apparatus 10, as viewed in FIG. 1, when the barrel 260 is in place, secured to the gun 120. The barrel 262 is closed at one end by a perforated disc 270 which is secured to the outwardly flaring portion 266 by a knurled bezel 268. The perforated disc 270 closes the bore of the cylindrical portion 262 of the barrel and is perforated, with a plurality of holes or apertures, to allow tear gas to exit from the barrel. The outwardly flaring portion 266 allows the gas to spread outwardly so as not to direct the gas in a relatively narrow or limited area or pattern. Rather, the gas is allowed to spread out so as to be most effective in a relatively short distance. If desired, the end of the barrel 260 could be open, rather than closed by the perforated disc.

Figure 8:
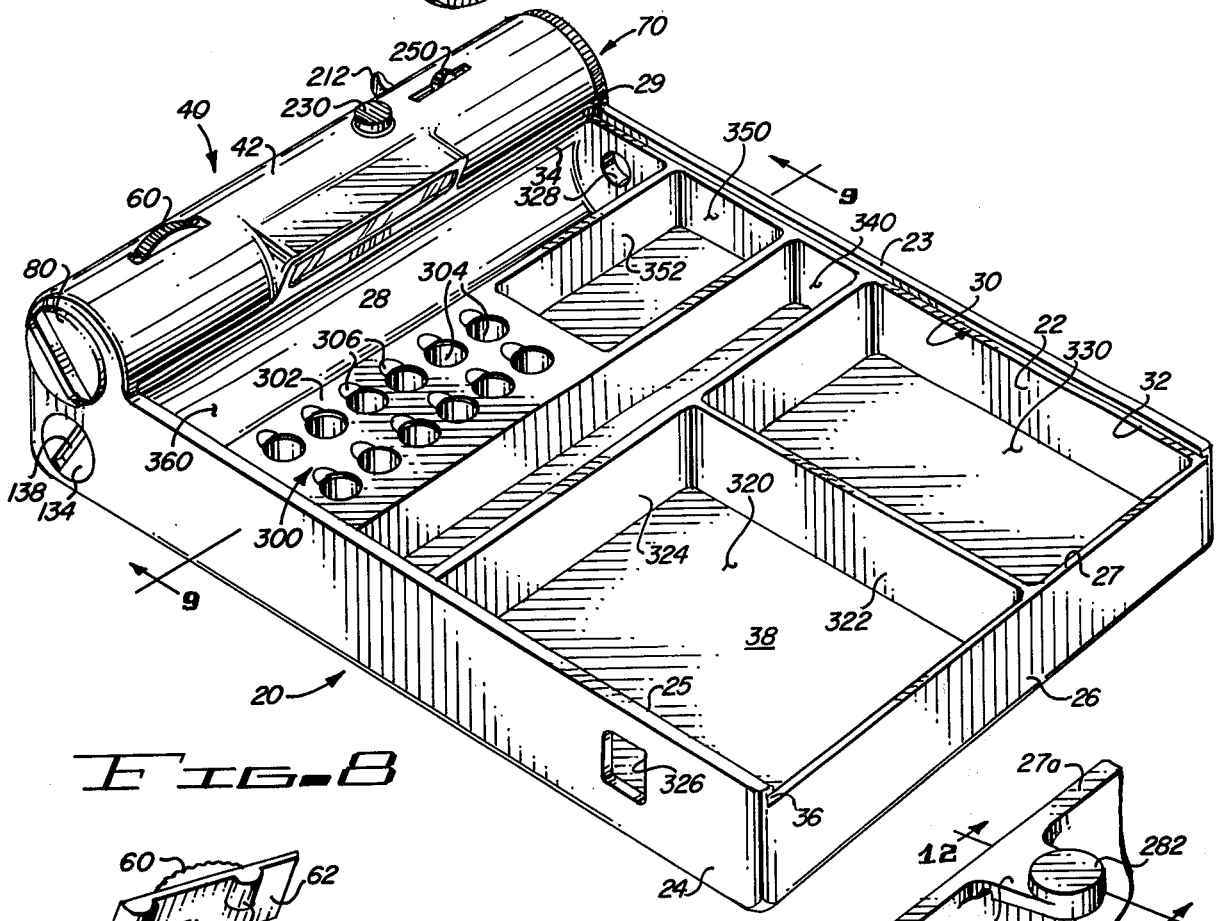
FIG. 8 is a perspective view of the apparatus of FIG. 1 with a portion of the apparatus of FIG. 1 removed showing compartments within the clipboard apparatus.

FIG. 8 is a perspective view of the clipboard apparatus of FIG. 1 with the top or slide 50 and the tray 290 removed to show an arrangement of various components and compartments disposed within the base 20.

The forward or front end 40 is viewed in FIG. 8 from a different angle than is shown in FIG. 1, and thus the battery end cap 80 is shown extending slightly outwardly from the left side 24 of the base 20. Beneath or below the end cap 80 is the plug 134 which extends into the bore 110, shown in FIG. 2. The slot 138 is shown recessed into the end of the plug 134. It will be noted, as shown in FIG. 2, that the plug 134 is substantially flush with the side 24 of the base 20. On the top 42 of the forward or front end 40 is the side switch 60 which makes and breaks the electrical circuitry for the two lights, including the spotlight 70 and the floodlight 45 which illuminates the top of the clipboard apparatus. The floodlight 45 is disposed within the hood 46 which extends rearwardly from the top portion of the front end 40 and extends slightly over the slide 50 (see FIG. 1). The lens 48 comprises a wall for the hood 46. The lens 48 is preferably removable to allow the lamp within the hood 46 to be replaced.

The trigger button or head 230 extends upwardly from the curved top surface 42 of the front end 40 and is disposed adjacent the safety 250. The cocking lever of pin 212 extends forwardly of the apparatus, substantially perpendicular to the longitudinal axis of the forward end 40. The cocking lever 212, the safety 250, and the trigger button 230 are components or elements of the gun apparatus illustrated in detail in FIGS. 2–7.

With respect to the portion of the base 20 behind or rearwardly of the front end 40, or that portion which, as shown in FIG. 1, is normally covered by the slide 50, the removal of the slide, and of the tray 240, discloses a plurality of compartments which may be appropriately used, as desired, for the storage of miscellaneous apparatus, such as pencils, pens, forms, a tape recorder, and the like.

The base 20 is shown with its side walls 22 and 24 extending upwardly from a bottom 38. A groove 38 extends inwardly into the sides 22, 24, and into the upper portion of a front wall 28 of the base 20 rearwardly of the foward portion 40 to receive the slide 50, as shown in FIG. 1. The groove 30 includes three portions, a right side portion 32, a forward or front portion 34, and a left side portion 36. The portions 32, 34, and 36 of the groove 30 are substantially continuous. The portions of the groove are spaced apart downwardly from top portions 23, 29, and 25, respectively, of the right side wall 22, the front 40, and the left side wall 24. The lower end wall 26 terminates with a top 27.

The back or lower end wall 26 is substantially parallel to the upper or front end wall 28. The distance between the front end wall 28 and the lower end wall 26 may be as desired, in accordance with the particular needs of the organization using the clipboard apparatus, with respect to the desired equipment, forms, and the like to be disposed within the base. The top 27 of the end wall 26 is generally in the same plane as the bottom of the groove 30 so that the slide 50 (see FIG. 1) rests on the top 27 as it does on the bottom portion of the continuous groove 30. The groove 58 for the tray 290 (see FIG. 1) is not shown in FIG. 8 because the tray and its groove may be omitted if desired. If the tray is utilized, the interior walls are shortened to terminate at the bottom of the groove.

The groove 58 is similar to the groove 30, parallel to it and beneath it.

Within the base 30, the bottom 38 preferably covers the entire bottom of the base 20, and there are a plurality of interior walls within the base which define a plurality of compartments. Various accessories, pencils, pens, forms, and the like, may be carried within the base. The tops of the interior walls are low enough to accommodate the tray 290.

Included within the base is a cartridge carrier portion 300 which includes a plurality of cylindrical depressions 304 extending downwardly from a top 302. The cylindrical depressions 304 receive cartridges, with the base of the cartridges extending upwardly, and the nose or front portion of the bullets or cartridges extending downwardly into the depressions 304. Each of the depressions includes a scallop 306 which extends from the top 302 downwardly and inwardly toward each of the cylindrical depressions 304. The purpose of the scallop is to expedite removal of the cartridges from the cylindrical depositories 304 by inserting a fingernail, or the like, at the rim of the cartridge to facilitate removal of the cartridges. Each depression 304 also includes a shallow counterbore 308 which receives the rim of a cartridge.

A law enforcement officer typically uses a revolver which holds six cartridges. A total of twelve cylindrical depressions or cartridge repositories are shown extending downwardly from the top 302 of the cartridge carrier 300. This comprises two complete refills for the revolver of the user. Tear gas cartridges may also be carried in a portion of the cartridge carrier, and such tear gas cartridges should be clearly marked, as for example, with a specific color coding on a portion of the cartridge carrier reserved for tear gas cartridges, or the like.

A compartment 320 is illustrated at the lower left-hand portion of the base 20. The compartment 320 is defined by a portion of the end wall 26, the left side wall 24, and a pair of interior walls or partitions 322 and 324. The partition 322 is substantially parallel to the side 24, and the partition 324 is substantially parallel to the end wall 26. The compartment 320 is dimensioned to receive, if desired, a tape recorder. For convenience in actuating the tape recorder without removing the slide 50, aperture 326 extends through the wall 24 and communicates directly with the compartment 320. Controls for the tape recorder, which may conveniently be a cassette recorder, are accessible through the aperture 326.

Another aperture 328 extends through the forward or front portion of the right side wall 22 adjacent the front portion 40 of the clipboard apparatus. The aperture 328 is illustrated as being round and it receives a microphone for use in conjunction with a tape recorder. In the alternative, the aperture 28 may include a recess or the like to hold the microphone. Obviously, appropriate circuit connectors extend between the aperture 328 and the compartment 320 for connection to the tap recorder apparatus disposed within the compartment 320. Such conductors are not illustrated in FIG. 8, but are known and understood in the art. Adjacent the compartment 320 is a compartment 330, which is preferably rectangular in configuration, similar to the compartment 320. The compartment 330 is defined by a portion of the side wall 322, a portion of the end wall 26, the intermediate partition 322, and a portion of the partition 324. Forms, and the like, may be stored in the compartment 330.

Forwardly of the compartments 320 and 330 is a compartment 340. As illustrated in FIG. 8, the compartment 340 extends between the side walls 22 and 24 and forwardly of the transversely extending partition 324. The compartment 340 is disposed adjacent the cartridge carrier portion 300 of the base 20 and it may be used for pencils, pens, and miscellaneous small or elongated elements.

A compartment 350 is located between the side 22 and the cartridge carrying portion 300 and forwardly of the compartment 340. The compartment 350 is smaller then either of the compartments 320 or 330, but it is also rectangular in configuration. Cards, and the like, may be disposed within the compartment 350.

Finally, a compartment 360 is disposed between the front walls 28 and the cartridge carrier 300 and the compartment 350. The compartment 360, like the compartment 340, is transversely extending between the side walls 22 and 24 and may be used for carrying batteries or a battery pack. to provide additional voltage for lamps. By placing batteries in series with the batteries 84 and 85, additional voltage may be provided. Or, by a parallel arranging of the batteries, additional power for a longer endurance life may be provided.

The arrangement of the compartments shown in FIG. 8 is but a sample of how the base 20 may be utilized for storage and for the disposition of various components. Obviously, the compartments within the base may be rearranged, redimensioned, or the like, as required by a user.

Figure 9:
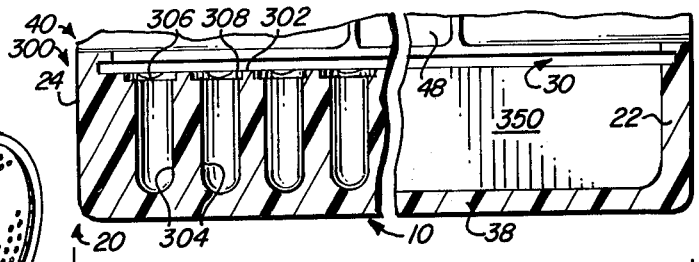
FIG. 9 is a view in partial section of a portion of the apparatus of FIG. 8 taken generally along line 9—9 of FIG. 8.

FIG. 9 is a view in partial section of the base 20 of FIG. 8 taken generally along line 9—9 of FIG. 8. It comprises a view in partial section to the cartridge carrier 300 and the compartment 350. The grooves 30 and 58 are shown extending into the side 22, the side 24, and the front 28. Above the groove 30 is the front portion 40 of the clipboard apparatus 10. The lens 48 of the floodlight is shown centrally disposed with respect to the clipboard apparatus 10.

With respect to the cartridge carrier portion 300 of the base 20, the cylindrical depressions 304 are shown extending downwardly from the top 302. The scallops 306 are shown extending also downwardly from the top 302, and radially inwardly toward the cylindrical depressions 304 which receive the cartridges. At the top of the depressions 304 are counterbored portions 308 which receive the outwardly extending flanges on the base of the cartridges. The depth of the counterbores is relatively shallow. They extend downwardly only a short distance to allow the base of the cartridges to be completely recessed downwardly from the top 302 within the cartridge carrier 300. Accordingly, the bases of the cartridge as disposed within the cartridge containing cylinders 304 are fully recessed downwardly from the top 302 and the cartridges are held in place within the cartridge carrier by the top or slide 50 and- /or the tray 290 (see FIG. 1) and will remain within the cartridge carrier 300 as long as the tray or top covers them, regardless of the orientation of the clipboard apparatus 10.

As clearly shown in FIG. 9, the cartridge carrier portion 300 of the base 20 is substantially solid except for the cartridge receiving cylinders 304. Thus the bottom 38 is thicker at the cartridge carrier portion 300 than at the compartment 350, or any of the other compartments illustrated in FIG. 8, because, at the cartridge carrier 300, the bottom 38 is virtually solid, and it extends solidly up to the top 302 to accommodate the cylindrical depressions 304.

Figure 10:
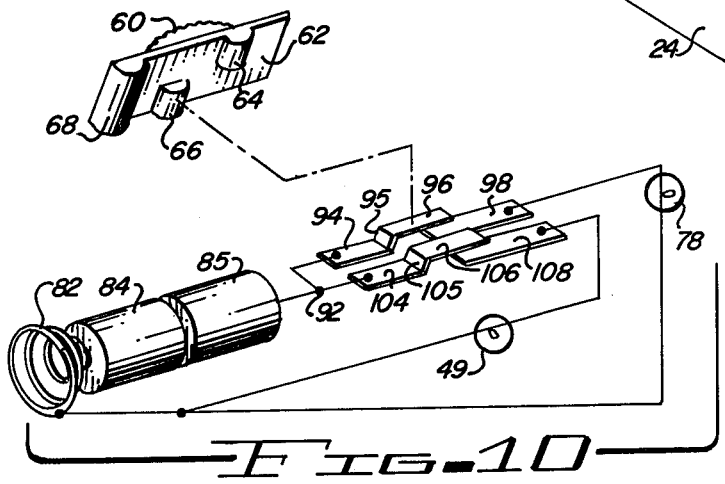
FIG. 10 is a schematic diagram of the electrical circuitry and the switches usable with the apparatus of the present invention.

FIG. 10 is a schematic circuit view of the electrical switch 60 illustrating the control of the two different lights included in the clipboard apparatus 10. The switch 60 includes a slide 62. The slide 62 is shown separated from the pair of batteries 84 and 85 and away from electrical contacts 94 and 104. It is understood that the representation of the batteries 84 and 85 is for illustrative purposes only. As indicated above, more batteries, or battery packs, may be used to provide the voltage required for the apparatus.

On the bottom of the slide 62 are three cam portions, including cam portion 64, cam portion 66, and cam portion 68. The cam portions 64 and 66 are spaced apart laterally and longidudinally with respect to the slide 62 and they are also spaced apart from the cam 68. The cam 68 extends transversely across the slide 62, while the cams 64 and 66 extend only part way, about half way, across the width of the slide 62. The cam 68 is thus about twice the width of either of the cam portions 64 or 66. The cam portions 64, 66, and 68 complete electrical circuits by camming spring contacts 96 and/or 106 into electrical engagement by direct contact with electrical connectors 98 and 108. The spring contact 96 is secured to the electrical contact 94 by an upwardly extending portion 95. The electrical conductor 98 is disposed beneath the spring contact 96. The spring contact 106 is connected to the electrical connector 104 by an upwardly extending portion 105 and the spring contact 106 is disposed above the electrical conductor 108. The lamp 78 is electrically connected to the conductor 98 and to the spring 82, which is a conductive spring and which makes contact with the base or negative terminal of battery 84. The lamp 49 is electrically connected also to the spring 82 and to the electrical conductor 108. The lamp 49 is for the floodlight which illuminates the top of the clipboard apparatus, while the lamp 78 is used with the spotlight 70 disposed in the side of the forward portion 40 of the clipboard apparatus 10.

The positive terminal of the battery 84 is biased by the spring 82 against the base or negative terminal of the battery 85, and the positive terminal of the battery 85 is biased also by the spring 82 against the electrical contact 92, which is in turn electrically connected to both the electrical contacts 94 and 104. The lamps 49 and 78 are in separate parallel electrical circuits between the electrical contact 92 and the spring 82. The separate electrical circuits are in turn controlled by the switch 60 and, more particularly, by the cams 64, 66, and 68 of the switch 60.

As illustrated in FIGS. 1 and 2, and discussed in conjunction therewith, the switch 60 moves longitudinally with respect to the forward end 40 of the clipboard apparatus 10. In the far left position, as shown in FIG. 1, both lamps 49 and 78 are in the off position, with both lamp circuits open. As the switch 60 is moved axially with respect to the forward end 40 of the clipboard apparatus 10, the cam 64, which extends downwardly from the bottom of the slide 62 and which includes a curved cam surface, contacts the spring contact 106 mechanically and causes the contact 106 to be moved or biased downwardly against the electrical conductor 108. As the spring contact 106 makes mechanical contact with the conductor 108, electrical connection is also made to close the electrical circuit including the spring 82, the batteries 84 and 85, the electrical contact 92, the electrical contact 104, and from electrical contact 104 through the intermediate portion 105 and spring contact 106, to the electrical conductor 108 and the lamp 49. The lamp 49 thus illuminates.

If the slide 60 is moved forwardly, the cam 64 moves away from the spring contact 106 which then moves away under its own spring bias from the conductor 108 to open the circuit for the lamp 49. The spring contact 106 must be kept in electrical contact with the conductor 108 against the inherent bias of the spring contact 106 and the intermediate portion 105, and when the mechanical connection is broken between the spring contact 106 and the conductor 108, the contact 106 will, of its own inherent bias, move away from the conductor 108. Thus when the cam 64 disengages the spring contact 106, the contact moves away from the conductor 108 to open the circuit with respect to the lamp 49.

As the slide 60 is moved forwardly to release the mechanical connection between the spring contact 106 and the conductor 108, the cam 66 moves into engagement with the spring contact 96 to cause the spring contact 96 to mechanically contact the conductor 98. The electrical circuitry for the lamp 78 is accordingly closed by the physical, and electrical, contacts or connection between the spring contact 96 and the conductor 98 through the contact 94 and the intermediate portion 95. The closing of the circuit between the batteries 84 and 85 and the lamp 78 results in the illumination of the lamp 78. The electrical contacts 94 and 104, with their intermediate portions 95 and 105 and their spring contact portions 96 and 106, are substantially and respectively identical. Similarly, the cams 64 and 66 are substantially identical, simply spaced apart laterally and longitudinally with respect to the slide 62 to actuate the two lamp circuits, as desired. However, the cam 68 extends continuously across the slide 62 to simultaneously close the electrical circuitry to illuminate both the lamps 49 and 78 at the same time.

The cam 68 is spaced longitudinally from the cams 64 and 66 and it extends across the full width of the slide 62. Thus, as the switch 60 is moved axially forwardly, the cam 66 moves off or out of engagement with the spring contact 96 to release the spring contact 96 from electrical and physical connection to the conductor 98. The spring contact 96 then biases itself away from the electrical conductor 98 to open the circuit to lamp 78. Continued forward or longitudinally axial movement of the switch 60 causes the cam 68 to contact both the spring contacts 96 and 106 which in turn results in substantially simultaneously closing the circuits for the lamps 49 and 78 to cause both lamps to be illuminated. Rearward movement of the switch 60 causes both lamps to turn off, and, depending on where the switch 60 is left, forward or rearward movement of the switch 60 results in the turning on and turning off of either of the lamps 49 and 78.

Figure 11:
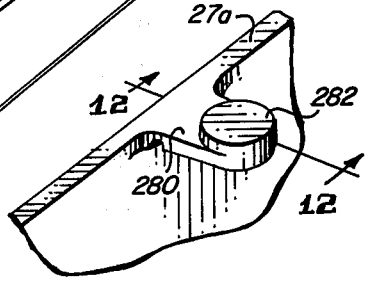
FIG. 11 is an enlarged detail view of a portion of the apparatus of the present invention.

FIG. 11 is an enlarged detail view of a portion of the apparatus of the present invention, comprising a lock arrangement for the slide 50 of FIG. 1. The lock arrangement comprises an alternate embodiment of the end wall 26 of FIG. 1, and the end wall in FIG. 11 is accordingly designated as end wall 26*a*. Extending outwardly, or rearwardly, from top 27*a* of end wall 26*a* is an extension tab 280. A lock button 282 extends upwardly from the top surface of the extension 280. The lock button 282 fits into the hole or aperture 56 of the slide 50. The extension 280 is of such resiliency that it maintains the button 282 in the hole or aperture 56 to prevent the slide 50 from moving until the button is forcibly removed from the hole or aperture 56 by downward pressure on the button through the hole 56.

Figure 12:
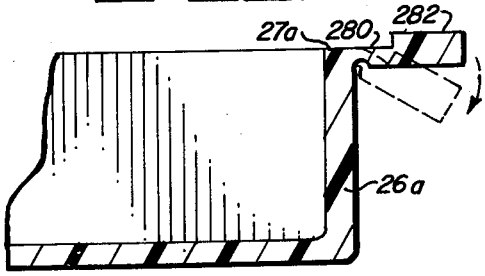
FIG. 12 is a view of the apparatus of FIG. 11 taken generally along line 12—12 of FIG. 11.

FIG. 12 is a view of the apparatus of FIG. 11 in partial section taken generally along line 12—12 of FIG. 11. It shows the extension 280 with its button 282 extending substantially outwardly and upwardly, respectively, from the top surface 27*a* of the wall 26*a*. In the upper or upright position of the button 282 as shown in FIGS. 11 and 12, the button 282 will be disposed within the hole or aperture 56 to thus lock the slide 50 and its groove 30 (see FIGS. 1 and 8). However a downward force or pressure on the top surface of the button 282 causes the button 282 to pivot downwardly to the position shown in phantom in FIG. 12 which causes the button 282 to be moved out of the hole or aperture 56. With the button 282 thus free of the aperture 56, the slide 50 may be moved outwardly in the groove 30 with respect to the base 20. The extension 280 and the button thus comprise a lock to hold the slide 50 to the base 20. The extension 280 is of sufficient flexibility to allow the button 282 to be moved downwardly to release the button from the aperture 56 without causing a break between the end wall 26*a* and the extension 30. As indicated previously, the hole or aperture 56 is also convenient for use as a finger or thumb hole for movement of the slide 50.

Figure 13:
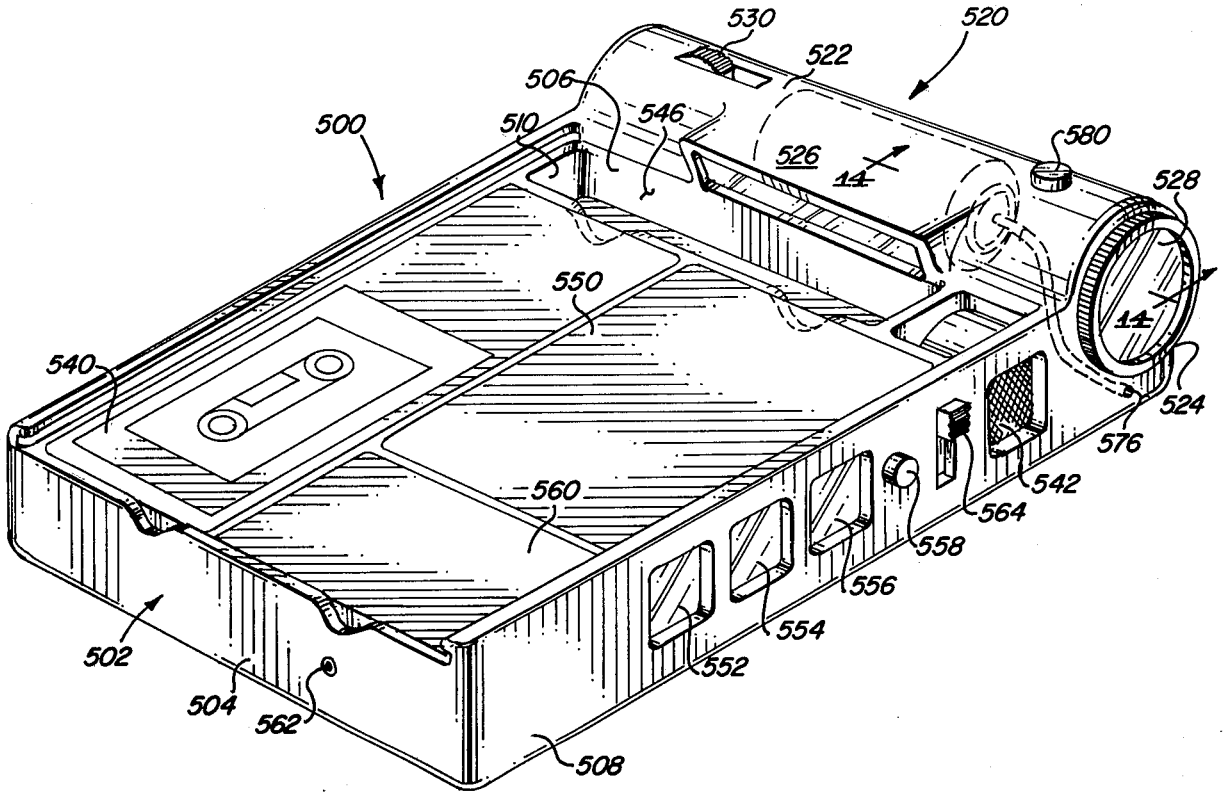
FIG. 13 is a perspective view of an alternate embodiment of the clipboard apparatus of the present invention.

FIG. 13 is a perspective view of clipboard apparatus 500, which comprises an alternate embodiment of the clipboard apparatus of the present invention. The clipboard 500 comprises a base 502 which includes a rear wall 504, a front wall 506, and a pair of side walls 508 and 510. Forwardly of the front wall 506 is a front end 520, which is substantially the same in overall configuration as is the front end 40 of FIGS. 1–8. It comprises a generally smoothly rounded top surface 522 which extends upwardly from the base 502 and it terminates in a smooth front wall 524. The front end 520 extends between the sides 508 and 510 with which it is substantially aligned.

Within the front end 520 are a pair of lights, including a floodlight 526 and a spotlight 528, both of which are operated by a switch 530. The lights 526 and 528, and their switch 530, are substantially identical to the lights 46 and 70 and their switch 60, as discussed above and as illustrated in detail in conjunction with FIGS. 1, 8, and 10.

Within the base 502 are a plurality of compartments for containing auxiliary equipment, such as a tape recorder 540, with its microphone 542 disposed on the side 508, adjacent the spotlight 528. The location of the microphone 542 is substantially the same location as illustrated above in conjunction with FIG. 8. The microphone 542 is disposed in a compartment 544 in the base 502, and connected to the recorder 540 by appropriate electrical conductors, not shown, extending between the recorder and the microphone.

In alignment with the compartment 544 is a compartment 546 which extends transversely across the clipboard apparatus 500 from the side 510 to the compartment 544 adjacent the front wall 506. The compartment 546 may be used for miscellaneous storage, as desired, such as additional batteries, or an alternate location for a mace cannister, which will be discussed below.

Rearwardly of the compartments 546 and 544, and extending inwardly from the side 508, is another compartment in which is disposed a camera 550. The camera 550 is disposed against the right side wall 508 of the base 502. Three apertures, 522, 554, and 556, extend through the side wall 508 for the camera 550. The aperture 552 communicates with a built-in flash unit in the camera 550, the aperture 554 communicates directly with the lens of the camera, and the aperture 556 communicates with an electric eye in the camera. A button or switch 558 extends outwardly from the side 508 adjacent the aperture 556. The switch 558 controls the shutter and thus the actuation of the camera 550.

Between the recorder 540 and the camera 550, and disposed between the rear wall 504 and the side wall 508, is a rechargeable battery pack 560. The battery pack may be used instead of the C or D size batteries discussed above. An aperture 562 extends through the end wall 504 to allow a recharger plug to connect directly to the battery pack. This allows the battery 560 to be recharged while in place in the clipboard apparatus 500. Appropriate conductors, not shown, extend from the battery pack to the lights 526 and 528, to the recorder 540, and to the camera 550.

Disposed within the front or forward end 520 is a mace cannister 570. The mace cannister is shown in phantom. The mace cannister 570 is an alternate to the gun apparatus illustrated above in conjunction with the embodiment of FIGS. 1–12. Mace from the cannister 570 is sprayed through an outlet aperture 572 in the side 508 below the spotlight 528.

The top of the clipboard, or slide, and a tray, as both illustrated in FIG. 1, have been omitted from the embodiment of FIG. 13 in order to illustrate fully the apparatus disposed within the base. It is understood that the top or slide and tray, if desired, for the clipboard apparatus 500 is substantially the same as the slide 50 and tray 290 illustrated in FIG. 1.

Figure 14:
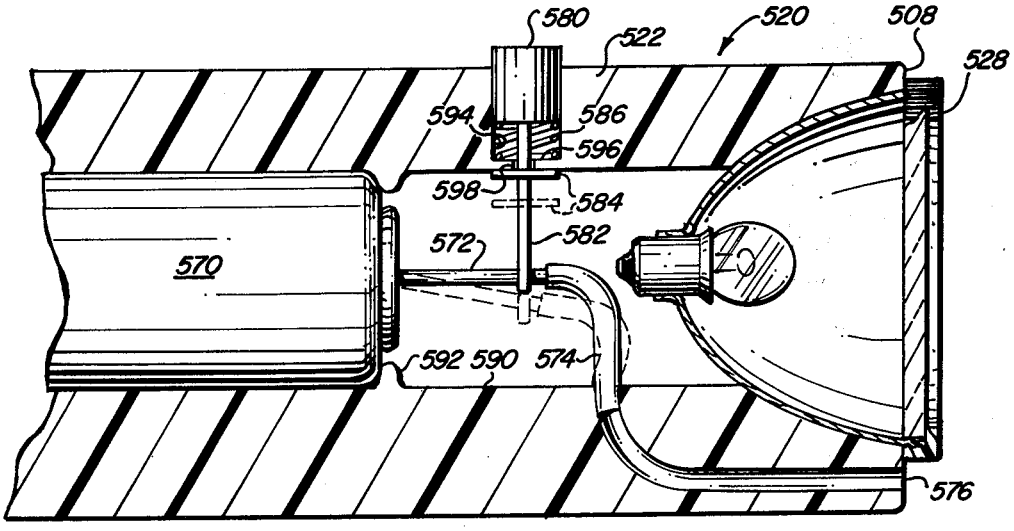
FIG. 14 is an enlarged view in partial section of a portion of the apparatus of FIG. 13, taken generally along line 14—14 of FIG. 13.

FIG. 14 is an enlarged view in partial section of a portion of the apparatus of FIG. 13 taken generally along line 14—14 of FIG. 13. It comprises a view in partial section through the front end 520 of the clipboard apparatus 500 illustrating the orientation and actuation of the mace cannister 570.

The mace cannister 570 is disposed within a bore 590 in the front end 520 of the clipboard apparatus 500. The bore communicates with the right side 508 of the base 502. The flashlight 528 is in part disposed within the bore 590. Within the bore 590 is a ridge 592 which extends radially inwardly circumferentially about the bore 590. The ridge 592 acts as a stop against which the cannister 590 is disposed. For removing and replacing a mace cannister 590, the bore 590 communicates with the exterior of the clipboard apparatus by well-known means.

The mace cannister 570 includes a nozzle 572 extending outwardly from the cannister and substantially in line with the longitudinal axis of the cannister. The nozzle 572 is a hollow tube which is secured to a flexible hose 574. The hose 574 extends from the nozzle 572 to the outlet 576. Upon actuation, chemical mace is propelled through the nozzle 572 and through the hose 574 outwardly of the apparatus through the outlet 576. The outlet 576 is simply an aperture or hole in the side wall 508 through which the chemical mace is sprayed from the hose 574.

The mace cannister is actuated to spray the chemical mace out of the cannister by movement of the nozzle 572. The movement of the nozzle 572 is accomplished by movement of the trigger 580. The trigger 580 includes an actuator 582 extending downwardly from the trigger and disposed against the nozzle 572. Preferably, the actuator 582 includes a bifurcated portion which is disposed about a nozzle 572.

The trigger 580 is disposed within a bore 594 which extends downwardly from the top surface 522 of the forward part 520 of the clipboard apparatus. The bore 594 includes a bottom end wall 596. The end wall 596 separates the bore 594 from the bore 590. An aperture or hole 598 provides communication between the bores 594 and 590. The actuator 583 extends through the aperture 598 to make contact with the nozzle 572.

A compression spring 586 is disposed within the bore 594 between the end wall 596 and the trigger 580. The compression spring biases the trigger upwardly out of the bore 594 to prevent actuation of the mace cannister 570. A retainer or pin 584 is secured to the nozzle 572 within the bore 590. The retainer is secured to the actuator 582 to limit the upward movement of the trigger with respect to the nozzle 572. The retainer accordingly prevents the spring 586 from causing the trigger 580 to move entirely out of the bore 594. As illustrated in FIG. 14, the retainer 584 is disposed against the wall of the bore 590 in the rest or off position.

When the trigger 580 is depressed downwardly with respect to the bore 594, the actuator 582 moves the nozzle 572 downwardly to the position shown in phantom in FIG. 14 to actuate the mace cannister to spray chemical mace out of the outlet or nozzle 576. Thus the trigger 580 must be manually depressed against the bias of the spring 586 to actuate the mace cannister 570. Upon release of the trigger 580, the spring 586 moves the trigger upwardly and the actuator 582 accordingly moves upwardly also.

The nozzle 572 of the mace cannister 570 is spring loaded to the neutral or unactuated position and must be manually moved against its inherent, spring-loaded bias in order to actuate the cannister. When the trigger 580, and its actuator 582, is in the up or neutral, unactuated position, the lower bifurcated portion of the actuator 582 allows the nozzle 572 to return and remain in its neutral and centered position.

The clipboard apparatus illustrated and discussed herein comprises a multipurpose tool for law enforcement officers of all types. The apparatus may be adapted to suit the needs of various types of law enforcement officers by varying the accessories included and by varying the design and layout of the compartments, the tray, and the like. By manufacturing the clipboard apparatus out of an appropriate material, such as "Lexan" polycarbonate, the apparatus may be effectively used also as a shield in an emergency.

While the principles of the invention have been made clear in illustrative embodiments, there will be immediately obvious to those skilled in the art many modifications of structure, arrangement, proportions, the elements, materials, and components used in the practice of the invention, and otherwise, which are particularly adapted for specific environments and operative requirements without departing from those principles. The appended claims are intended to cover and embrace any and all such modifications, within the limits only of the true spirit and scope of the invention. This specification and the appended claims have been prepared in accordance with the applicable patent laws and the rules promulgated under the authority thereof.

What is claimed is:

1. Multi-purpose clipboard apparatus for law enforcement personnel, comprising, in combination:

base means, including
- first and second side walls,
- a lower end wall,
- a forward portion,
- a bottom,
- a plurality of interior walls defining, with the first and second side walls, the lower end wall, the forward portion, and the bottom, a plurality of storage compartments, and
- a top for providing a writing surface and movable to provide access to the storage compartments;

tray means disposed beneath the top of the base means and movable in the base means, light means for providing illumination for the base means, including a first light means for illuminating the top and a second light means defining a spotlight shining away from the base means; and gun means disposed in the forward portion for firing a cartridge generally parallel to the second light means, and trigger means for firing the gun means extending externally of the base means.

2. The apparatus of claim 1 in which the first and second side walls of the base means include groove means for receiving the top, and the top is movable in the groove means for providing access to the storage compartments.

3. The apparatus of claim 2 in which the base means further includes means for providing a source of electrical current for operating the first and second light means.

4. The apparatus of claim 3 in which the base means includes switch means for selectively operating the first light means and the second light means.

5. The apparatus of claim 1 in which the tray means includes a plurality of depressions for holding papers, forms, and the like.

6. The apparatus of claim 1 in which the gun means includes:
- a barrel;
- a cylinder adjacent the barrel and having a bore communicating with the barrel;
- means for supporting a cartridge between the barrel and the bore of the cylinder;
- bolt means movable in the bore;
- a firing pin on the bolt for firing;
- a first spring means in the bore for biasing the bolt toward the barrel;
- latching means for holding the bolt against the bias of the first spring means; and
- trigger means for releasing the latching means to allow the bolt to move under the bias of the first spring means to fire a cartridge.

7. The apparatus of claim 6 in which the latching means includes a pair of latching fingers spaced apart from each other, and second spring means for biasing the latching fingers towards each other.

8. The apparatus of claim 7 in which the bolt means includes a groove for receiving a portion of the latching fingers to hold the bolt means against the bias of the first spring means.

9. The apparatus of claim 8 in which the trigger means includes cam means for camming the latching fingers out of the groove to allow the bolt means to move in the bore of the cylinder.

10. The apparatus of claim 9 in which the trigger means includes safety means for preventing movement of the cam means.

11. Multi-purpose clipboard apparatus for law enforcement personnel, comprising, in combination:

base means, including first and second side walls, a lower end wall, a forward portion, a bottom, a plurality of interior walls defining, with the first and second side walls, the lower end wall, the forward portion, and the bottom, a plurality of storage compartments; and a top for providing a writing surface and movable to provide access to the storage compartments;

light means for providing illumination for the base means, including a first light means for illuminating the top and a second light means defining a spotlight shining away from the base means; and accessory means disposed in the base means and communicating with a side wall for providing auxiliary uses for the clipboard apparatus.

12. The apparatus of claim 11 in which the accessory means comprises gun means disposed in the forward portion of the base means for firing a cartridge generally parallel to the second light means.

13. The apparatus of claim 11 in which the accessory means comprises recorder means disposed in a compartment in the base means for recording sounds.

14. The apparatus of claim 11 in which the accessory means includes camera means disposed in the base means for selectively taking pictures.

* * * * *